US009419374B2

(12) United States Patent
Umbach

(10) Patent No.: US 9,419,374 B2
(45) Date of Patent: Aug. 16, 2016

(54) CONNECTOR WITH VIBRATION PROTECTION

(71) Applicant: Lumberg Connect GmbH, Schalksmuehle (DE)

(72) Inventor: Frank Umbach, Hagen (DE)

(73) Assignee: Lumberg Connect GmbH, Schalksmuehle (DE)

( * ) Notice: Subject to any disclaimer, the term of this patent is extended or adjusted under 35 U.S.C. 154(b) by 0 days.

(21) Appl. No.: 14/805,002

(22) Filed: Jul. 21, 2015

(65) Prior Publication Data

US 2016/0134050 A1 May 12, 2016

(30) Foreign Application Priority Data

Nov. 10, 2014 (DE) ..... 10 2014 116 322

(51) Int. Cl.

| | |
|---|---|
| ***H01R 4/38*** | (2006.01) |
| ***H01R 13/533*** | (2006.01) |
| ***H01R 13/622*** | (2006.01) |
| *H01R 13/52* | (2006.01) |
| *H01R 13/639* | (2006.01) |

(52) U.S. Cl.

CPC ..... *H01R 13/533* (2013.01); *H01R 13/622* (2013.01); *H01R 13/5202* (2013.01); *H01R 13/5219* (2013.01); *H01R 13/639* (2013.01)

(58) Field of Classification Search

CPC .. H01R 13/193; H01R 13/622; H01R 13/625; H01R 2103/00; H01R 13/6215; F21S 6/002

USPC ..... 439/259, 312, 314, 320–323, 359, 578

See application file for complete search history.

(56) References Cited

U.S. PATENT DOCUMENTS

| | | | | |
|---|---|---|---|---|
| 4,109,990 A * | 8/1978 | Waldron | H01R 13/622 411/315 |
| 4,588,245 A * | 5/1986 | Schwartz | H01R 13/622 439/312 |
| 5,192,219 A * | 3/1993 | Fowler | H01R 13/622 285/92 |
| 6,527,575 B2 * | 3/2003 | Scholler | H01R 13/622 439/320 |
| 7,189,091 B1 * | 3/2007 | Montena | H01R 9/0521 439/322 |
| 7,207,820 B1 * | 4/2007 | Montena | H01R 13/5219 439/275 |

(Continued)

FOREIGN PATENT DOCUMENTS

| | | |
|---|---|---|
| DE | 4205440 A1 | 8/1993 |
| DE | 200003224 U1 | 6/2001 |

(Continued)

*Primary Examiner* — Thanh Tam Le

(74) *Attorney, Agent, or Firm* — Von Rohrscheidt Patents

(57) ABSTRACT

A plug connector for providing an electrical connection with a counter piece, the plug connector including a housing in which contacts that are supported in a front portion of the housing with respect to a plug in direction are connectable with a cable which is run out of a rear portion of the housing with respect to the plug in direction; a securing sleeve which is supported on the housing rotationally movable in a circumferential direction and which provides a securing screw connection for a plug connection between the connector and the counter piece, wherein an axial section of the housing and an axial section of the securing sleeve enter a form locking engagement at least at an end of a movement of the securing screw connection wherein the form locking engagement provides vibration protection for the plug connection; and an elastic seal which secures the plug connection against contaminants.

8 Claims, 8 Drawing Sheets

(56) References Cited

U.S. PATENT DOCUMENTS

| | | | | |
|---|---|---|---|---|
| 7,331,807 | B2 * | 2/2008 | Scholler | H01R 13/622 439/320 |
| 7,413,457 | B2 * | 8/2008 | Mehnert | H01R 13/622 285/81 |
| 7,874,860 | B2 * | 1/2011 | Starke | H01R 13/622 439/216 |
| 8,241,068 | B2 * | 8/2012 | Millard | H01R 13/6461 439/320 |
| 8,342,879 | B2 * | 1/2013 | Amidon | H01R 9/0518 439/320 |
| 8,568,164 | B2 * | 10/2013 | Ehret | H01R 13/622 439/322 |
| 2006/0051999 | A1 | 3/2006 | Allemann et al. | |

FOREIGN PATENT DOCUMENTS

| | | | |
|---|---|---|---|
| DE | 20042021043 | U2 | 8/2006 |
| DE | 102006007191 | A1 | 8/2007 |

* cited by examiner

CONNECTOR WITH VIBRATION PROTECTION

RELATED APPLICATIONS

This application claims priority from and incorporates by reference German Patent Application DE 10 2014 116 322.2 filed on Nov. 10, 2014.

FIELD OF THE INVENTION

The invention relates to a plug connector for establishing an electrical connection with a counter piece which includes a housing, in which contacts are arranged in plug in direction x in the front, the contacts being connectable with a cable positioned in plug in direction x in the back which cable can be run out of the housing, with a securing sleeve which is mounted rotationally movable on the housing to provide a screw connection that secures the plug connection with the counter piece, wherein at least at the end of the securing screw connection an axial section of the housing and an axial section of the securing sleeve engage each other in form closure that provides vibration protection of the plug connection, with an elastic seal which secures the plug connection against influences of contaminants.

BACKGROUND OF THE INVENTION

A known connector is disclosed in DE 42 05 440 A1. The connector shown there is equipped with a securing sleeve with a locking profile on an inner circumference line as well as—according to the embodiment—a locking profile formed by two diametrically opposed teeth on the side of the contact support. When the locking profiles meet during the screwing action securing the plug connection, they engage form-fitting with each other. At this point the radial rise of the first protrusion over the second protrusion is ensured by at least one of the protrusions being forced out of its rest position. This can be ensured by an appropriate material weakness zone or by the choice of the material for the protrusions.

It is known from DE 200 03 224 U1, too, to provide an elastomeric ring between the protrusions of the locking profiles, the compression of the ring enabling the rising movement. The connectors known in the state of the art ensure a sufficient protection of the plug connection against vibration by the locking profiles of the connector housing or contact support and of the securing sleeve engaging with each other. A further advantage can be seen in the fact that in the plug connection, which is usually composed of two connectors, the vibration protection is provided by one of the connectors only. In existing installations the vibration protection may be retrofitted by the exchange of the cable harness without the need to exchange each of the connector components.

Finally, DE 10 2006 007 191 A1 shows a connector with a contact support covered by a securing sleeve. The contact support is provided with a locking profile on its outer circumference, its teeth comprising each a flat and a steep tooth flank. The snap-in hook on the side of the securing sleeve slips off the flat tooth flanks during the screwing onto the counter piece and thus offers an easy protection of the plug connection. In the opposite direction the snap-in hook hits the steep tooth flanks and thus impedes the loosening of the safety screw connection.

However, it has been revealed that especially in cases where plug connections are frequently separated and re-established, an increased wear of the locking profiles rubbing one against the other or of the elastomer ring has to be noted. In an extreme case this may lead to an insufficiency of the vibration protection after a certain number of connection cycles.

BRIEF SUMMARY OF THE INVENTION

It is therefore the object of the invention to provide a new connector with sufficient low-wear vibration protection.

This object is accomplished by a plug connector for providing an electrical connection with a counter piece, the plug connector including a housing in which contacts that are supported in a front portion of the housing with respect to a plug in direction are connectable with a cable which is run out of a rear portion of the housing with respect to the plug in direction; a securing sleeve which is supported on the housing rotationally movable in a circumferential direction and which provides a securing screw connection for a plug connection between the connector and the counter piece, wherein an axial section of the housing and an axial section of the securing sleeve enter a form locking engagement at least at an end of a movement of the securing screw connection wherein the form locking engagement provides vibration protection for the plug connection; and an elastic seal which secures the plug connection against contaminants, wherein a first locking profile is formed along an outer circumference of the axial section of the housing, wherein the first locking profile includes at least one first protrusion and at least one first recess wherein a second locking profile is formed along an inner circumference of the axial section of the securing sleeve, wherein the second locking profile includes at least one second protrusion and at least one second recess, wherein the securing sleeve is supported on the housing so that the securing sleeve has radial movability relative to the housing, wherein a radial gap between the housing and the securing sleeve enabling the radial movability enables a radial rise of the at least one first protrusion above the at least one second protrusion when the at least one first protrusion and the at least one second protrusion contact during the movement of the securing screw connection, and wherein the elastic seal acts in a resetting manner against the radial rise.

The main advantage of the invention is that forces acting on the protrusions of the securing sleeve and the connector housing and causing wear can be reduced considerably, since the securing sleeve itself is being displaced radially when the radial rise movement occurs. The friction between two protrusions against the resetting forces causing the wear is thus minimized.

It is provided that the securing sleeve forms a locking profile with several second protrusions and several second recesses which are positioned in an alternating pattern along the inner circumference, especially when the housing forms a locking profile with several first protrusions and second recesses which are positioned in an alternating pattern along the outer circumference.

By increasing the number of protrusions, especially on the side of the securing sleeve, but also on the side of the connector housing a finer detent mechanism can be implemented at the end of the screwing movement securing the plug connection.

It is of significant importance for the invention that the circumferential pitch of the locking profiles of housing and securing sleeve differ. This is an essential prerequisite for the rise movement of a first protrusion above a second protrusion that at least one further corresponding first protrusion engages one further second recess.

Consequently, an advantageous embodiment of the invention is characterized by the fact that when axial sections contact during the securing screw movement of the first and second protrusions and the first and second recesses, they impose to the securing sleeve an oscillating radial movement which is induced by the rising and penetrating process.

The different pitch of the locking profiles ensures that the first and second protrusions can slide over one another when providing the vibration protection so that the wear of the protrusions is strongly reduced. Resilient protrusions are thus not required for the connector according to the invention.

Therefore it is possible for the locking profiles on the side of the securing sleeve and the housing to be made from of a substantially rigid material such as hard plastic or metal.

BRIEF DESCRIPTION OF THE DRAWINGS

Further advantages of the invention become apparent from the following description of an embodiment of the invention with reference to drawing figures, wherein.

DETAILED DESCRIPTION OF THE INVENTION

Figure 1:
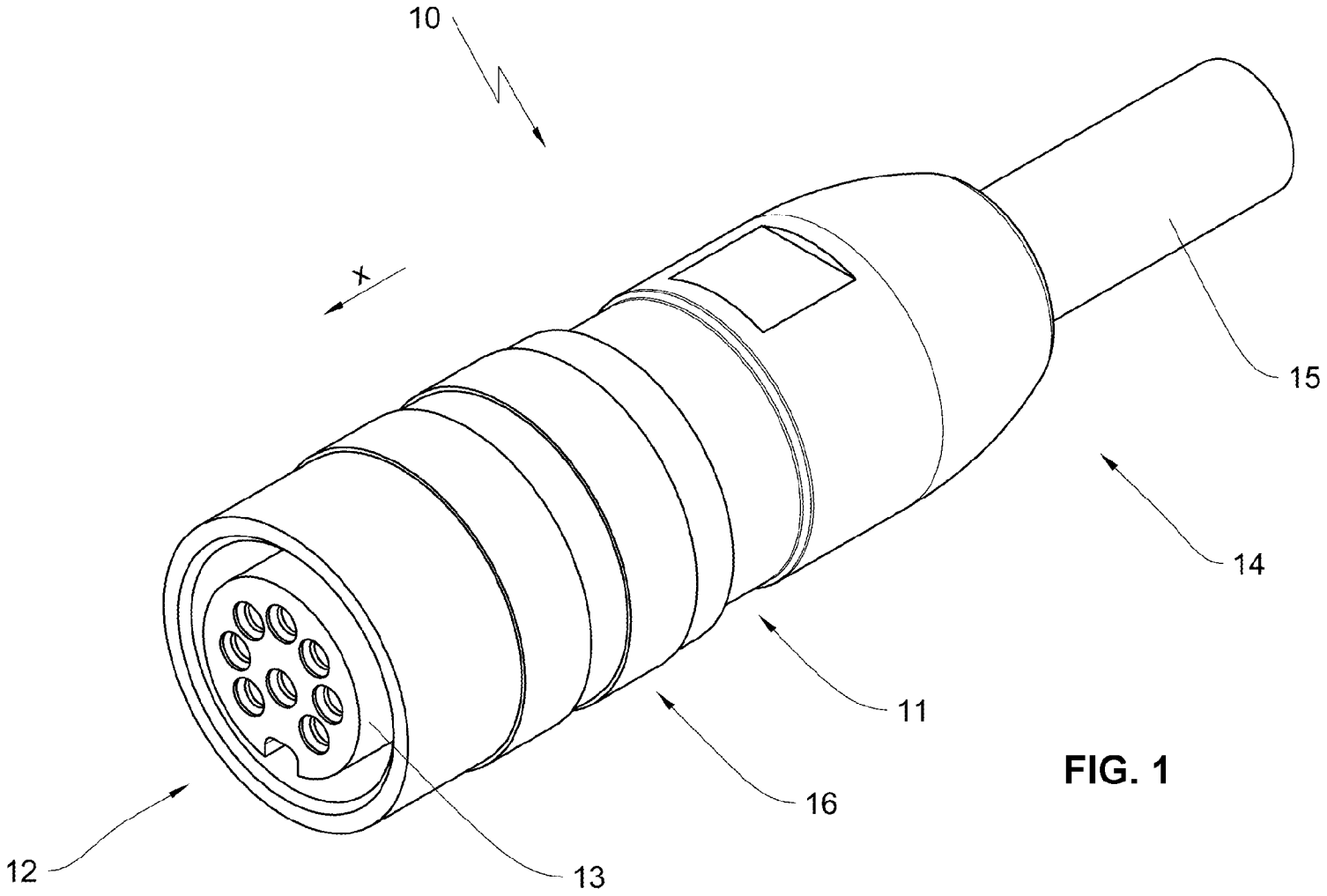
FIG. 1 illustrates a connector according to the invention in a perspective view.

In the drawing figures, the connector according to the invention is designated with reference numeral 10.

As can be seen from FIG. 1, the connector 10 includes a connector housing 11, holding at its end 12 positioned in plug in direction x in front a contact support 13 for receiving electrical plug contacts. At its end 14 positioned in plug in direction x in the back of the connector 10 a cable 15 is run out. Finally, the connector housing 11 supports a securing sleeve 16 in its front section which also reaches over the contact support 13 and includes a thread which is not illustrated. This thread is used to screw the securing sleeve 16 onto a plug-compatible second connector which is not shown either in FIG. 1. The screw connection secures the plug connection.

Figure 2:
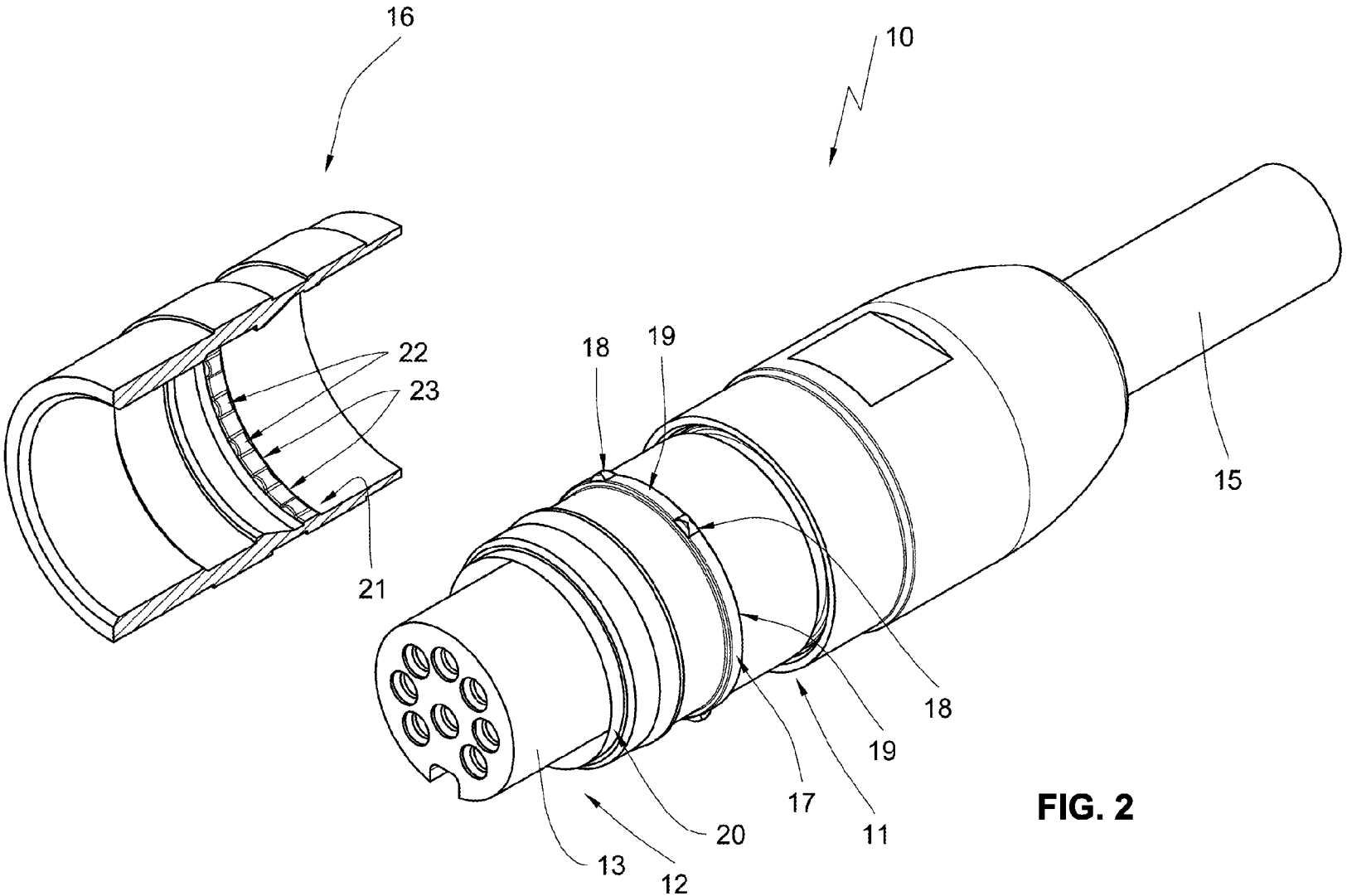
FIG. 2 illustrates the connector according to FIG. 1 with partial sectional view of the securing sleeve.

From FIG. 2 it is apparent that the connector housing 11 includes a first locking profile 17 in its front axial section enveloped by the securing sleeve 16, the locking profile 17 being arranged along an outer circumference on the connector housing 11. It includes several first protrusions 18 disposed over the circumference, first recesses 19 being arranged between them. Moreover, the contact support 13 is surrounded by a ring shaped rubber seal 20 that can be contacted by a second connector (not shown in FIG. 2) in order to protect the electrical connection against contaminants.

FIG. 2 moreover shows the axially cut securing sleeve 16. The latter is disposed with an axial section including a second locking profile 21. The second locking profile 21 is arranged on an inner circumference and has second protrusions 22 disposed over the circumference, second recesses 23 being arranged between them.

The securing sleeve 16 is mounted rotationally movable on the connector housing 11 and is provided with radial mobility relative to the connector housing 11. Finally, the securing sleeve is also axially movable on the connector housing 11 to a certain extent.

Figure 3:
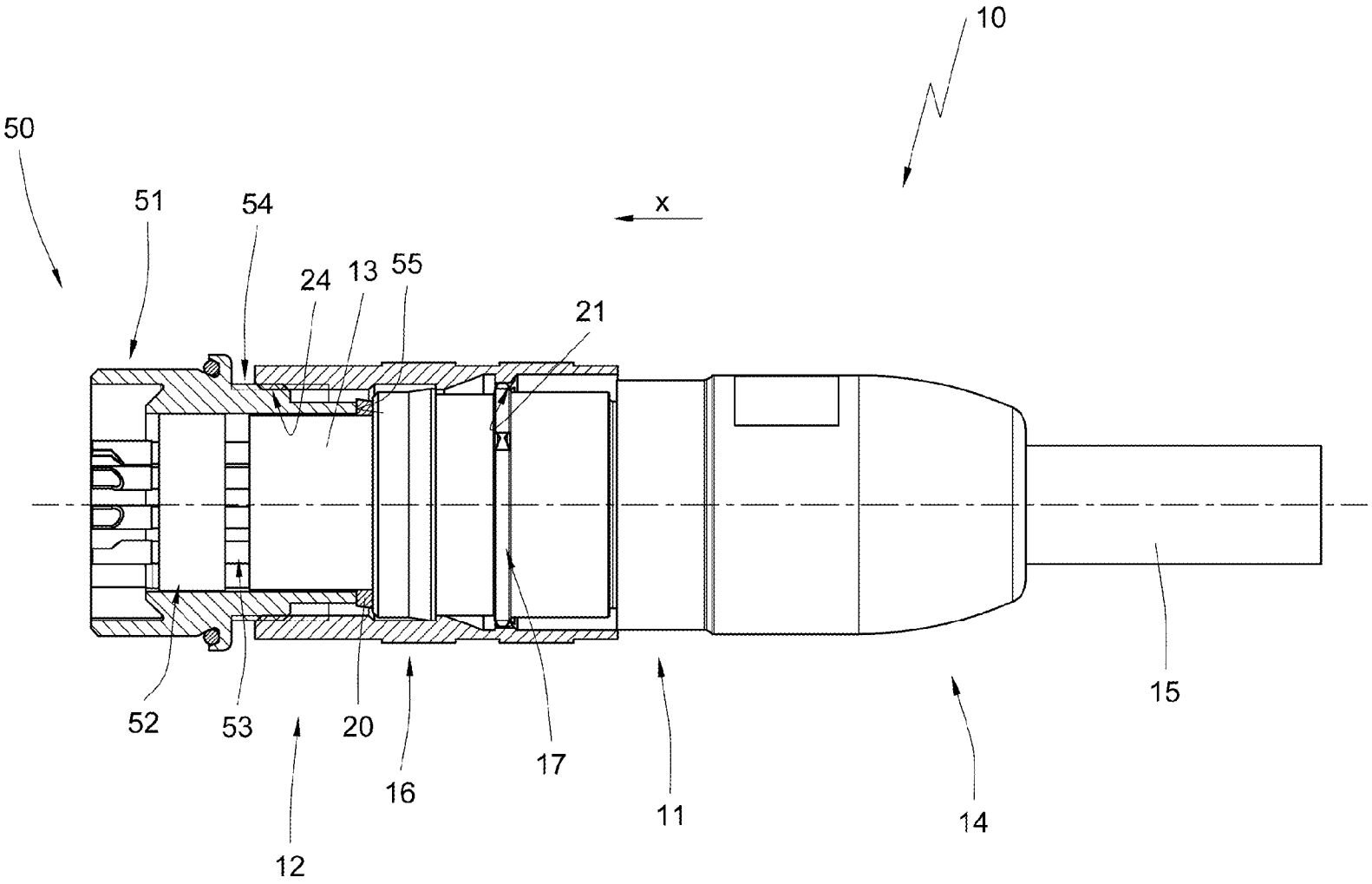
FIG. 3 illustrates a plug connection using the connector according to FIG. 1 in a partial sectional view.

FIG. 3 now shows a plug connection provided between the connector 10 according to the invention and a second connector 50 that serves as a counter piece. The second connector can be a panel connector for example. The second connector 50 also has a connector housing which is numbered with 51. The housing holds a contact support 52 which is equipped with plug contacts 53. The connector housing 51 has an outer thread 54, engaging with an internal thread 24 of the securing sleeve 16. The connector housing 51 is disposed with a reception compartment in which the contact support 13 of the connector 10 enters. A face side 55 of the second connector 50 contacts the rubber sealing 20 of the connector 10 when producing the plug connection. When producing the screw connection to secure the plug connection the securing sleeve 16 is brought into its position at the front end in plug in direction x so that the first locking profile 17 and the second locking profile 21 are matched.

Figure 4:
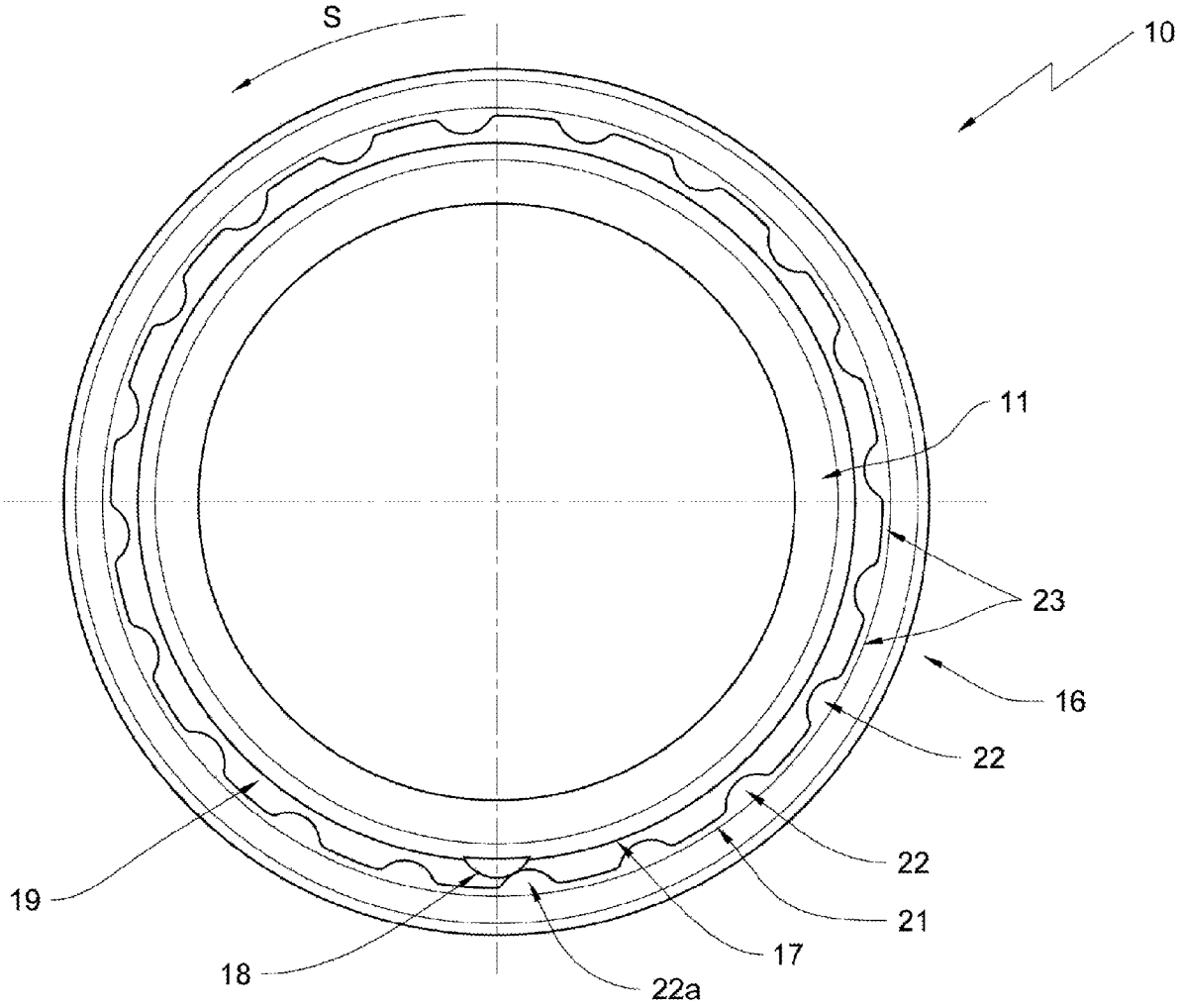
FIG. 4 illustrates a radial sectional view of the connector according to FIG. 1 in the area of the locking profiles according to a first embodiment with a securing sleeve arranged concentrically.
Figure 5:
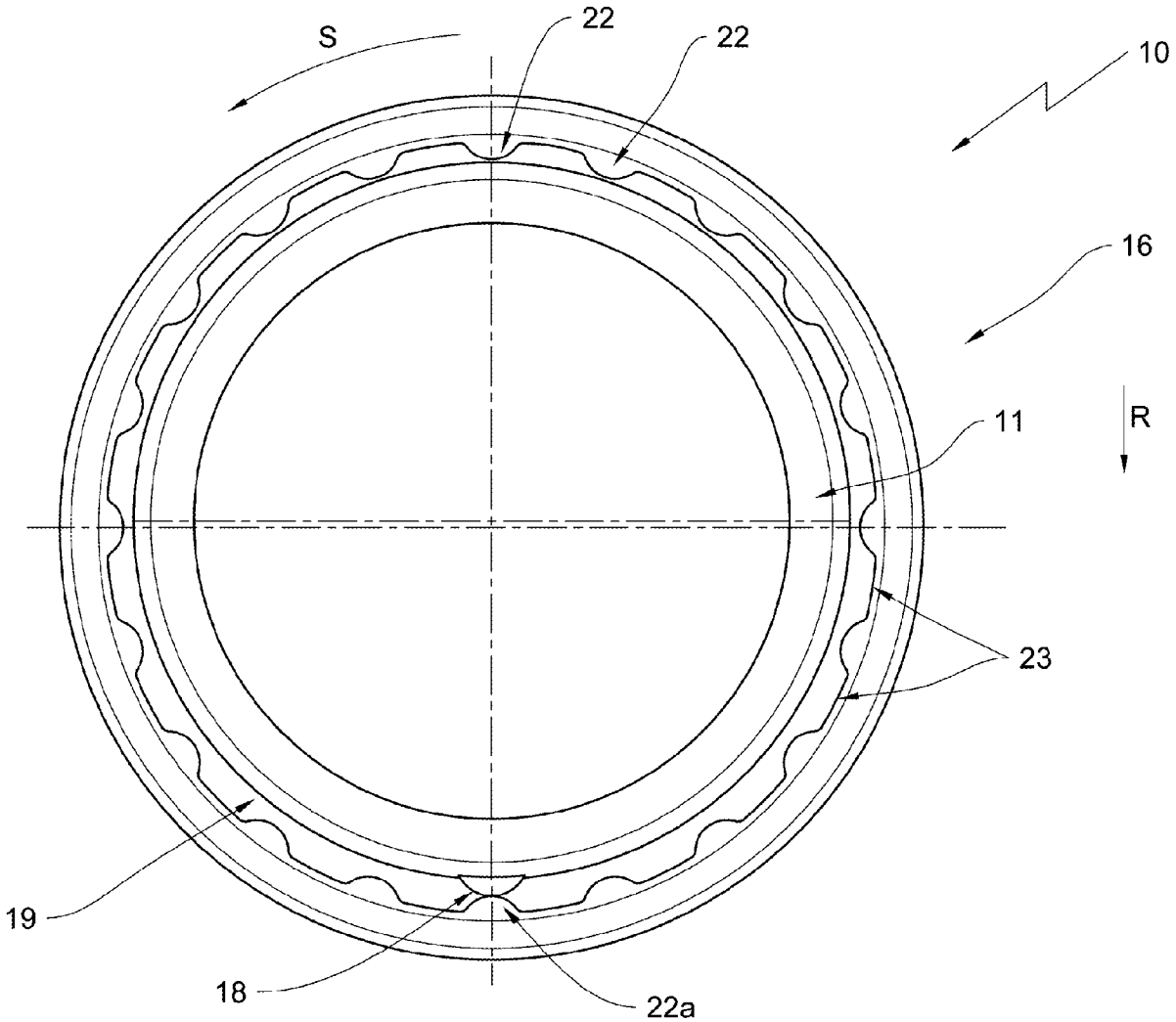
FIG. 5 illustrates the view according to FIG. 4 with a securing sleeve arranged eccentrically.
Figure 6:
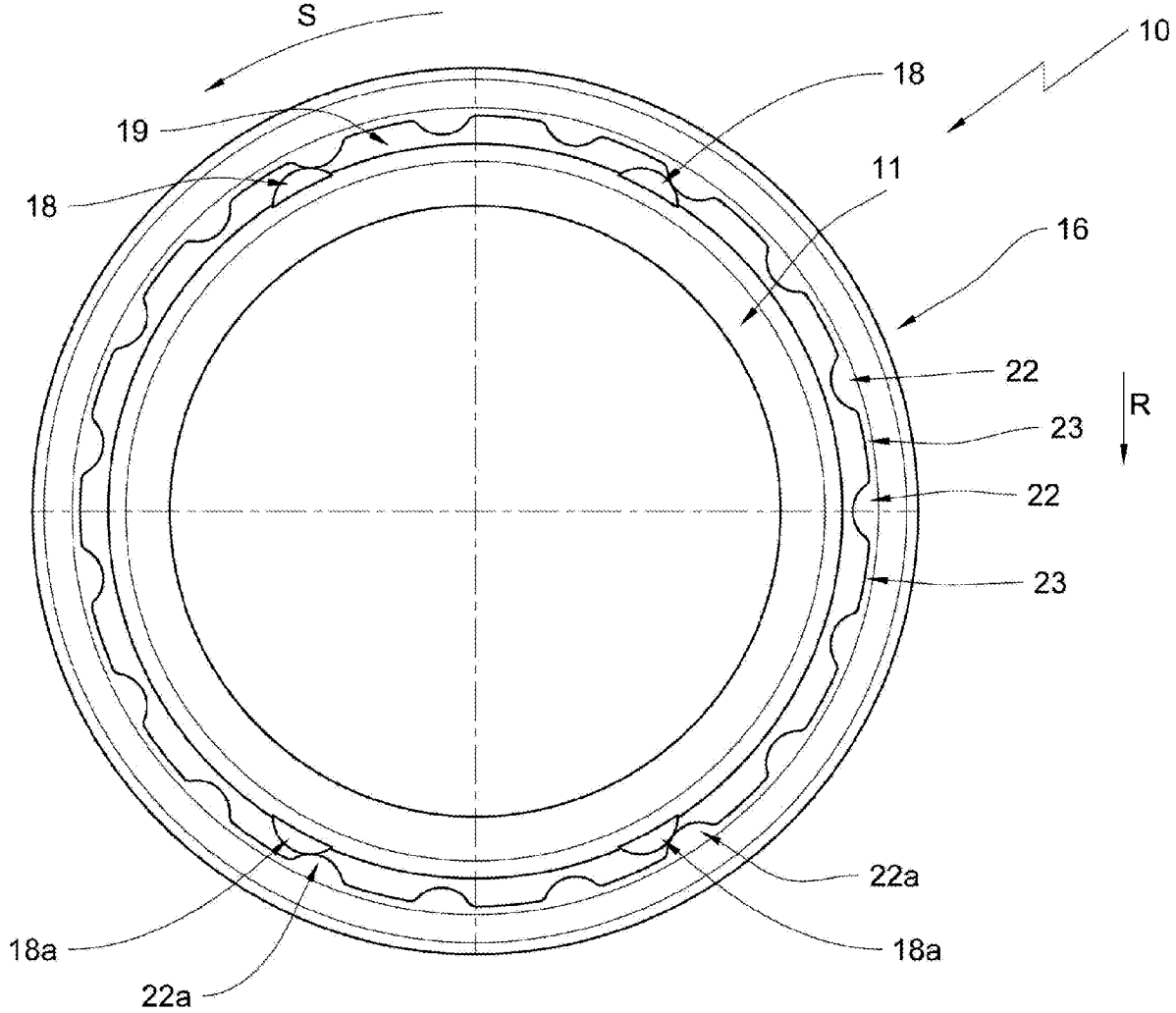
FIG. 6 illustrates a radial sectional view of the plug connector according to FIG. 1 in the area of the locking profiles according to a second embodiment with a securing sleeve arranged concentrically.
Figure 7:
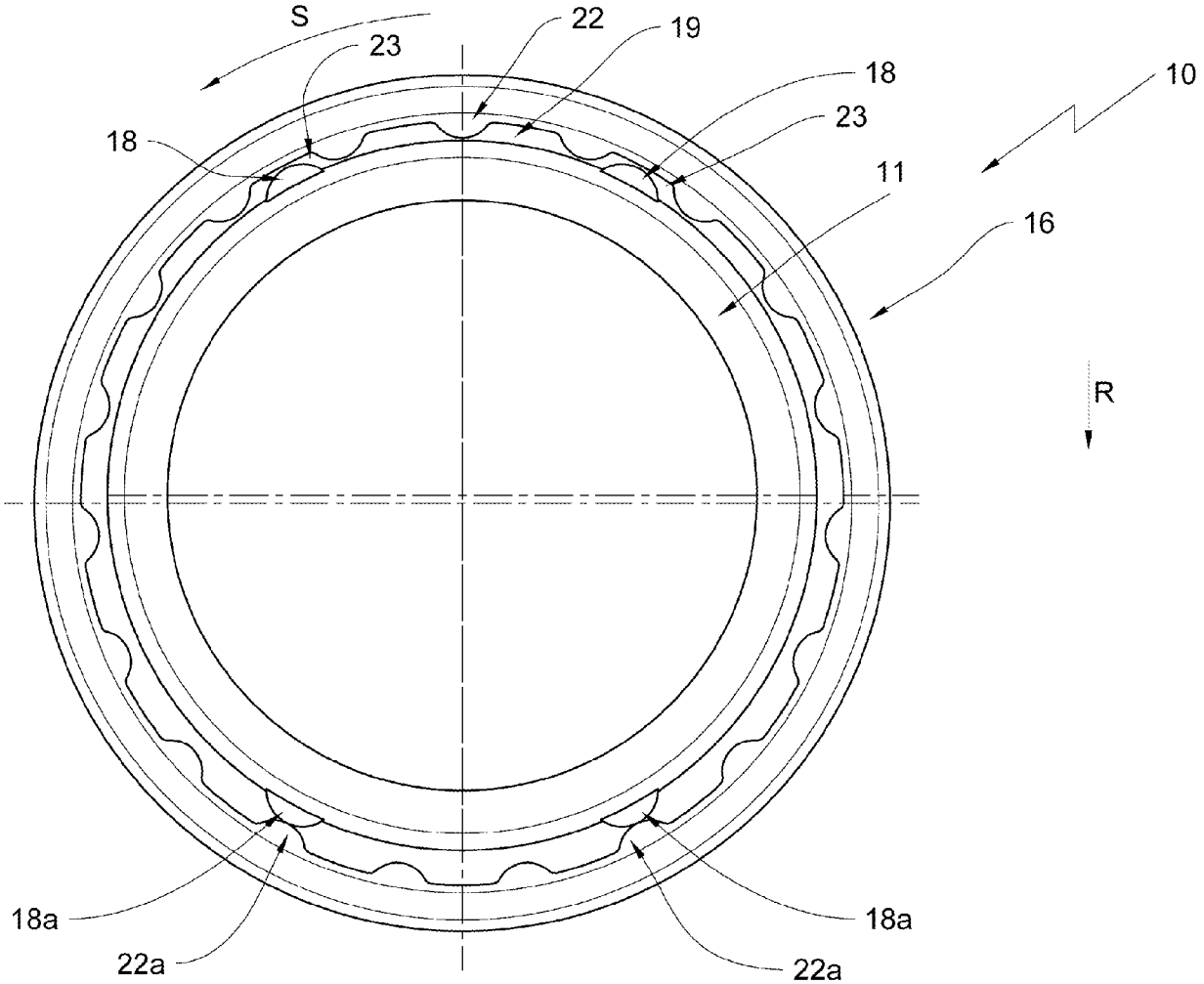
FIG. 7 illustrates the view according to FIG. 5 with a securing sleeve arranged eccentrically.

The engagement between the first locking profile 17 of the connector housing 11 and the second locking profile 21 of the securing sleeve 16 will now be explained using the FIGS. 4 to 7, the FIGS. 4 and 5 showing a first embodiment of the locking profile and the FIGS. 6 and 7 showing a second embodiment of the locking profiles 17 and 21.

FIG. 4 shows a radial section cut through the opposing axial sections of the connector housing 11 and the securing sleeve 16 holding the first locking profile 17 and the second locking profile 21. The second locking profile 21 is provided with a number of second protrusions 22 which are spaced one from another by second recesses 23. The first locking profile 17 is shown here in its simplest form. It includes exactly one first protrusion 18 and exactly one first recess 19, whereas the latter extends along the circumference which is not occupied by the protrusion. In FIG. 4, the sleeve 16 and the connector housing 11 are arranged concentric; the first protrusion 18 contacts a second protrusion 22 and has to pass it during the continuing screwing movement in direction S.

Neither the first protrusions 18 nor the second protrusion 22*a* are provided in a resilient way or have elastic material characteristics. Quite to the contrary, in an advantageous embodiment, the first locking profile 17 and the second locking profile 21 are made from metal. A continuous movement in direction S (in the example this is the counterclockwise direction) leads to the situation presented in FIG. 5.

During the rise of the first protrusion 18 above the second protrusion 22*a*, as shown in FIG. 5, a radial displacement of the securing sleeve 16 occurs in direction R, whereas the remaining second protrusions 22 engage into the first recesses 19. Therefore, the securing sleeve 16 is placed eccentric relative to the connector housing 11 in FIG. 5.

As will be described later, the seal 20 acts as an elastomeric element against the eccentric radial movement of the securing sleeve 16 to reset and forces the latter into its concentric neutral position. Continuous turning of the securing sleeve 16 in direction S thus leads to a back shift, so that the first protrusion 18 will engage the next second recess 23. When the first locking profile 17 and the second profile 21 engage at the end of the screwing movement securing the plug connection and the rise movement of the first protrusion 18 above the second protrusions 22 takes place, the securing sleeve 16 is thus forced to perform a radial oscillating movement relative to the common axial axis of securing sleeve 16 and connector housing 11. The resetting force of the seal 20 acting against each rise movement provides that the connector housing 11 and the securing sleeve 16 return to their concentric neutral position and turning against the securing movement S of the securing sleeve 16 is inhibited by the second protrusion 22 running against the first protrusion 18. In this way the vibration protection of the plug connection is ensured.

In particular the locking profile 17 of the connector housing 11 is shown in its simplest form in the FIGS. 4 and 5, namely with one protrusion 18 and one recess 19. Of course, the vibration protection is also ensured in this embodiment. It is also possible to provide the second locking profile in its simplest form with one protrusion 22 and one recess 23.

In any case, however, a better vibration protection is obtained if the first locking profile 17 and the second locking profile 21 have several protrusions 18/22 and recesses 19/23. Concerning this, reference is made to FIGS. 6 and 7 showing an advantageous embodiment. The first locking profile 17 again is formed on the side of the connector housing. It holds four first protrusions 18 spaced over the circumference and in between them four first recesses 19. The securing sleeve 16 holds several second protrusions 22 spaced over its circumference and in between them second recesses 23. In FIG. 4 the coaxial neutral position of the connector housing 11 and the securing sleeve 16 is shown. The first protrusions 18 are positioned in the second recesses 23. The second protrusions 22 are positioned in the first recesses 19. Supposing a screwing movement in direction S—here in counterclockwise direction—first protrusions 18*a* obviously run onto second protrusions 22*a*. The upcoming rise shown in FIG. 7 therefore requires an eccentric shift of the securing sleeve 16 in radial direction R according to FIG. 7. This is made possible by a deeper penetration of corresponding protrusions 18 into the respective recesses 23. In return, the corresponding second protrusions 22 penetrate deeper into the first recesses 19.

Also for this embodiment, it becomes clear that during continuous turning in direction S the securing sleeve 16 performs an oscillating radial movement about the in case of concentric arrangement common longitudinal axis of connector housing 11 and securing sleeve 16. In this case, too, the seal 20 acts resetting against the radial shift R of the securing sleeve.

Figure 8:
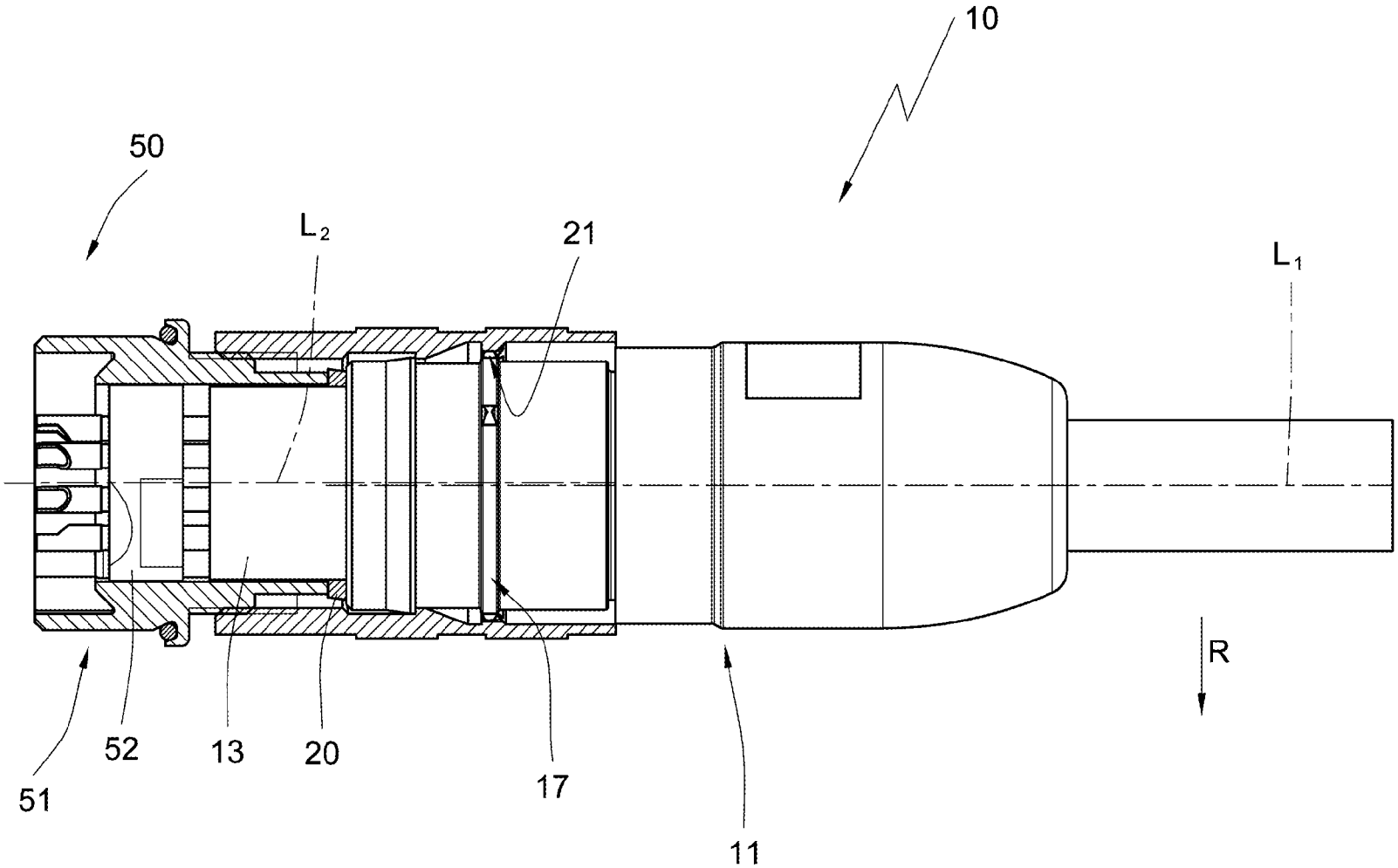
FIG. 8 illustrates the view according to FIG. 3 showing provision of a plug connection with vibration protection.

FIG. 8 shows the plug connection according to FIG. 3 in the condition of a rise movement according to FIG. 7 or FIG. 5. Here, it is shown that a resetting deformation of the seal 20 occurs as a result of the radial shift R. It is presumed that the longitudinal axis $L_1$ of the connector 10 and $L_2$ of the connector 50 are parallel displaced. But it is also possible that the longitudinal axis $L_1$ and $L_2$ are tilted relative to each other during the rise movement of the first protrusions 18 above the second protrusions 22.

The locking profiles 17 and 21 shown in the FIGS. 4, 5, 6 and 7 show a main precondition for the implemented vibration protection by form-locking engagement of the respective locking profiles 17 and 21. The main precondition is the different indexing of the respective locking profiles 17 and 21. The distances between adjacent first protrusions 18 differ from the distances between adjacent second protrusions 22. It is provided that, during a rise movement of a first protrusion 18 above a second protrusion 22, corresponding protrusions 18 and 22 are able to engage second recesses 23 or 19. This ensures the radial evasion of the securing sleeve 16 during the rise movement.

To summarize, a new connector 10 is disclosed having an advantageous vibration protection. This protection is implemented by a locking profile 17 on the side of the connector housing 11 and a corresponding locking profile 21 on the side of a securing sleeve 16, wherein the form-lock between the locking profiles 17 and 21 is provided by an eccentric radial movement of the securing sleeve 16 relative to the connector housing 11. The resetting mechanism maintaining the form-lock is provided by the connector seal 20, which is preexistent. In this case it is sufficient to provide one of the connectors 10/50 with a vibration protection according to the invention. It is even possible to ensure the radial rise movement simply through usual manufacturing tolerances when the locking profiles 17 and 21 are dimensioned accordingly.

The vibration protection has special low-wear characteristics since the resetting forces are not defined by the material of the locking profiles 17 and 21 but simply by the seal 20. Moreover, regarding the here described vibration protection, it is possible to use non-elastic, wear-resistant materials, such as metal or hard plastic.

REFERENCE NUMERALS AND DESIGNATIONS

10 connector
11 connector housing
12 front end
13 contact support
14 back end
15 cable
16 securing sleeve
17 locking profile of 11
18 first protrusion of 17
19 first recess of 17
20 seal
21 second locking profile of 16
22 second protrusion of 16
23 second recess of 16
24 internal thread
x plug in direction
S threading direction
R radial movement
$L_1$ longitudinal axis of 11
$L_2$ longitudinal axis of 50
50 second connector
51 connector housing
52 contact support
53 plug contact
54 external thread
55 front wall of 50

What is claimed is:

1. A plug connector for providing an electrical connection with a counter piece, the plug connector comprising:

a housing in which contacts are supported in a front portion of the housing that is in front of the housing relative to a plug in direction of the plug connector into the counter piece wherein the contacts are connectable with a cable which is run out of a rear portion of the housing that is in a rear of the housing relative to the plug in direction of the plug connector into the counter piece;

a securing sleeve which is supported on the housing so that it is rotatable and provides a securing screw connection for a plug connection between the plug connector and the counter piece, wherein an axial section of the housing and an axial section of the securing sleeve enter a form locking engagement at least at an end of a movement of the securing screw connection, wherein the form locking engagement provides vibration protection for the plug connection; and an elastic seal which secures the plug connection against contaminants, wherein a first locking profile is formed along an outer circumference of the axial section of the housing, wherein the first locking profile includes at least one first protrusion and at least one first recess, wherein a second locking profile is formed along an inner circumference of the axial section of the securing sleeve, wherein the second locking profile includes at least one second protrusion and at least one second recess, wherein the securing sleeve is supported on the housing so that the securing sleeve has radial movability relative to the housing, wherein a radial gap between the housing and the securing sleeve enables the radial movability of the securing sleeve and enables a radial rise of the at least one first protrusion above the at least one second protrusion when the at least one first protrusion and the at least one second protrusion contact each other during the movement of the securing screw connection, and wherein the elastic seal acts in a resetting manner against the radial rise.

2. The plug connector according to claim 1, wherein the securing sleeve forms the second locking profile with plural second protrusions and plural second recesses, and wherein the plural second protrusions and the plural second recesses are arranged in an alternating pattern along the inner circumference of the axial section of the securing sleeve.

3. The plug connector according to claim 1, wherein the housing forms the first locking profile with plural first protrusions and plural first recesses, and wherein the plural first protrusions and the plural first recesses are arranged in an alternating pattern along the outer circumference of the axial section of the housing.

4. The plug connector according to claim 1, wherein the securing sleeve forms the second locking profile with plural second protrusions and plural second recesses, wherein the plural first protrusions and the plural first recesses are arranged in an alternating pattern along the inner circumference of the axial section of the securing sleeve, wherein the housing forms the first locking profile with plural first protrusions and plural first recesses, and wherein the plural first protrusions and the plural first recesses are arranged in an alternating pattern along the outer circumference of the axial section of the housing.

5. The plug connector according to claim 4, wherein a circumferential pitch of the first locking profile of the housing and a circumferential pitch of the second locking profile of the securing sleeve differ.

6. The plug connector according to claim 4, wherein the radial rise of one of the plural first protrusions over one of the plural second protrusions is enabled by at least one additional first protrusion penetrating into at least one additional second recess.

7. The plug connector according to claim 6, wherein the plural first protrusions and the plural second protrusion and the plural first recesses and the plural second recesses impart an oscillating radial movement upon the securing sleeve when the securing sleeve is rotated relative to the housing, wherein the oscillating movement is caused by the radial rise.

8. The plug connector according to claim 1, wherein the at least one first locking profile at the securing sleeve and the at least one second locking profile at the housing are made from a substantially rigid material selected from the group consisting of hard plastic and metal.

* * * * *